US005842928A

United States Patent [19]

McGinnis

[11] Patent Number: 5,842,928

[45] Date of Patent: Dec. 1, 1998

[54] AMUSEMENT PARK SWING RIDE

[76] Inventor: Henry J. McGinnis, 7241 Martha La., Fort Worth, Tex. 76112

[21] Appl. No.: 853,553

[22] Filed: May 9, 1997

Related U.S. Application Data

[60] Provisional application No. 60/017,552 May 10, 1996.

[51] Int. Cl.[6] ..... A63G 9/16

[52] U.S. Cl. ..... 472/118; 472/119

[58] Field of Search ..... 472/118, 119, 472/80, 50, 135, 136, 137

[56] References Cited

U.S. PATENT DOCUMENTS 3,476,385 11/1969 Foy ..... 472/80

5,267,906 12/1993 Kitchen et al. .

5,573,465 11/1996 Kitchen et al. ..... 472/118

*Primary Examiner*—Kien T. Nguyen

*Attorney, Agent, or Firm*—James E. Bradley

[57] ABSTRACT

An amusement ride provides a very large swing. The ride has a tower with two spaced apart legs connected at the upper ends by a cross-member. A boom extends perpendicular to the cross-member at the upper end of the tower. A swing line is secured to one end of the boom and has a harness at its lower end. A carriage rolls on a track along the lower side of the boom. The carriage has an engagement member which will engage the swing line and cause it to take up toward the opposite end of the boom, lifting the passenger. Once the passenger is at the desired elevation, the engagement member releases the swing line, allowing the passenger to swing between the legs of the tower.

20 Claims, 5 Drawing Sheets

AMUSEMENT PARK SWING RIDE

This is a Provisional application Ser. No. 60/017,552, filed on May 10, 1996.

TECHNICAL FIELD

This invention relates in general to amusement park rides, and in particular to a large swing.

BACKGROUND ART

One type of amusement ride is basically a very large swing. It has a swing-supporting tower which usually has two legs, forming an arch. A swing line is attached to the tower. A separate take-up tower will be spaced from the first tower. After the passenger has been secured in the harness at the lower end of the swing line, a take-up line extending from the take-up tower will be used to lift the passenger. A winch is used to pull the take-up line inward. Once at the desired height, the take-up line releases the swing line to allow the rider to swing under the arch. U.S. Pat. No. 5,267,906 describes such an amusement ride.

The passenger must not come too close to the ground as he swings downward. To avoid this, the lower end of the swing line will place the passenger a number of feet above the ground at the lowest point in the swinging movement. While providing safety, this presents a problem for loading the passenger onto the swing because the harness will be too high to reach from the ground. For access to the harness, a moveable platform is rolled out under the arch of the tower to elevate the passenger and the workers who will strap the passenger in. After the passenger is secured to the swing line, the platform is rolled back out of the way.

While satisfactory, the moveable platform is fairly expensive and requires maintenance. Furthermore, a slight risk exists that due to a mistake, the platform will not be moved entirely out of the way of the passenger. Also, the separate take-up tower takes up a considerable amount of space, as well as requiring additional cost of construction.

DISCLOSURE OF INVENTION

In this invention, a large swing ride is provided which does not require a separate take-up tower, nor does it require a separate loading platform. A boom having first and second ends is mounted to a tower. A swing line attaches to the first end of the boom and has a harness or carrier at the lower end. A carriage is moveable along the boom from the first end toward the second end. The carriage has an engaging member which has bearing surface that will engage the swing line while in a locked position. The carriage, when moved toward the second end, will take up the swing line, causing it to advance toward the second end of the boom. This lifts the lower end of the swing line and the passenger, as well as drawing the passenger up toward the second end of the boom. At the desired elevation, the engaging member is moved to a released position, which frees the swing line, allowing it to swing downward.

Preferably the swing line is a fixed length line. The length of the line will be set high enough so that the passenger will be several feet above the ground at the lowest point. To avoid needing a loading platform, the first end of the boom will tilt downward during loading. While the first end of the boom is tilted downward, the rider will be strapped into the harness. Then the first end of the boom is tilted back upward to the riding position, raising the passenger above the ground.

In one embodiment, the boom is tilted by using a tilt line which attaches between the second end of the boom and an anchor point located below the boom. The anchor point is adjustable for increasing and decreasing the length of the tilt line. The first end of the boom is made heavier than the second end so that the boom will tilt naturally by gravity unless restrained. The tilt line holds the boom in the desired riding position. When the anchor point adjusts and loosens the tilt line, the boom is allowed to tilt downward.

BEST MODE FOR CARRYING OUT THE INVENTION

Figure 1:
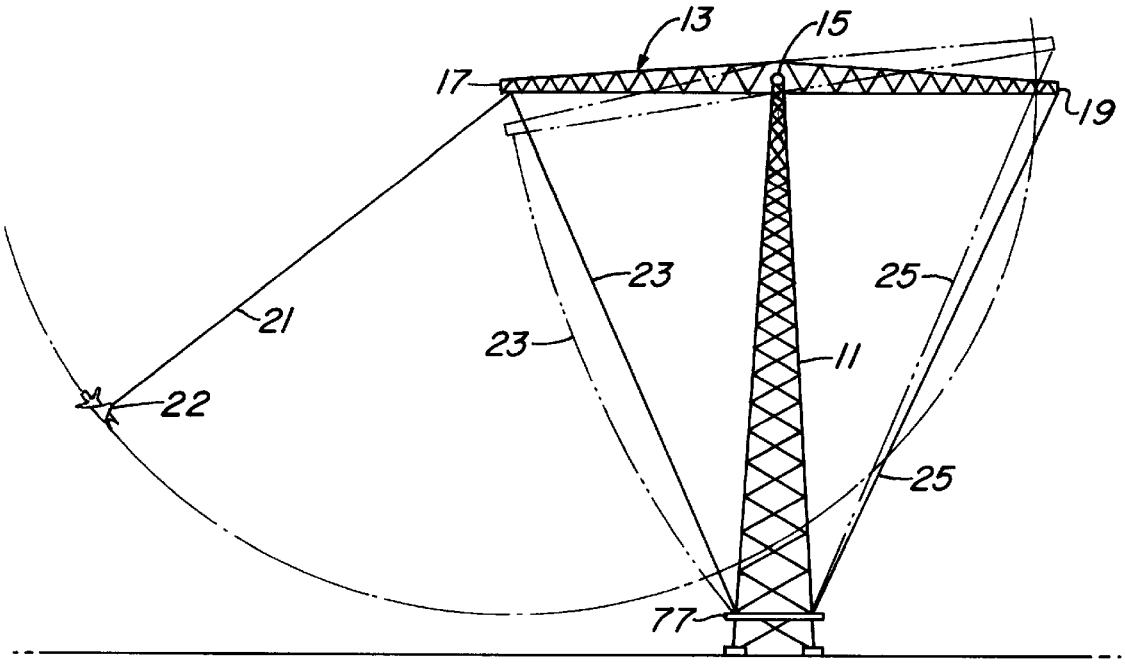
FIG. 1 is a side view of swing ride constructed in accordance with my invention.
Figure 2:
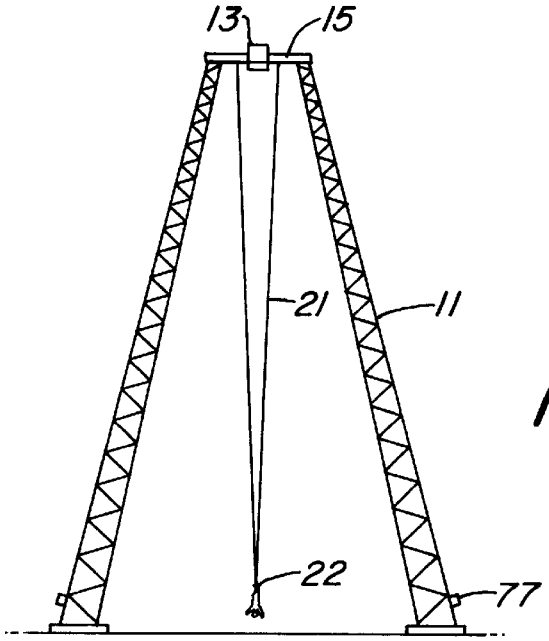
FIG. 2 is a front view of the swing ride of FIG. 1.
Figure 3:
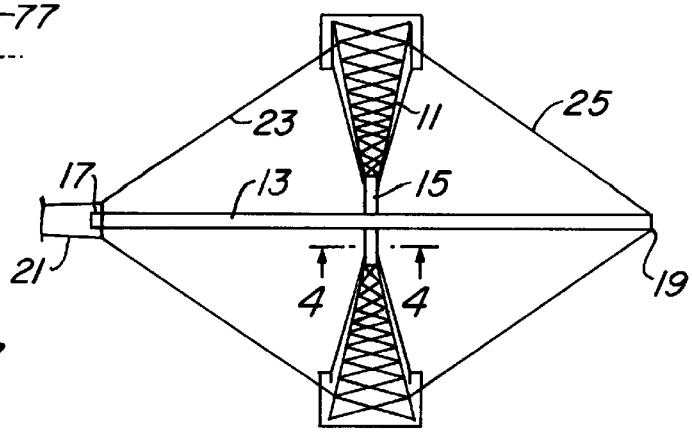
FIG. 3 is a top plan view of the swing ride of FIG. 1.

Referring to FIG. 1, the swing ride includes a tower 11 which has two legs that extend upward and converge toward each other, as shown in FIGS. 2 and 3. Tower 11 is formed of braces and lattices and may exceed 150 feet. A boom 13 extends horizontally between the two legs of tower 11 in forward and rearward directions. Boom 13 is pivotally supported on a cylindrical cross-member 15. Cross member 15 is a large pipe that is stationarily secured to the upper end of each of the legs of tower 11. Boom 13 has a forward end 17 and rearward end 19. Forward end 17 is heavier than rearward end 19, causing boom 13 to tilt when allowed to do so, as indicated by the dotted lines.

A pair of fixed length swing cables 21 are stationarily mounted to forward end 17. A rider harness or carrier 22 is secured to the lower ends of swing cables 21 for receiving a person or persons. The upper ends of swing cables 21 are stationarily fixed to forward end 17 of boom 13. The lengths of swing cables 21 are fixed. When the rider is pulled back to the proximity of rearward end 19 and released, he will swing forward in a large arc.

Fixed and movable support cables 23, 25 control the tilting of boom 13. Fixed support cables 23 are fixed in length and extend from forward end 17 to a lower portion of each leg of tower 11. Movable support cables 25, also referred to as tilt cables, are fixed at their upper ends to rearward end 19. The lower ends of movable support cables 25 are secured to movable couplers or anchor points at a lower portion of each leg of tower 11. When boom 13 is tilted, the movable couplers increase the lengths of movable support cables 25 while fixed support cables 23 will sag, as shown by the dotted lines in FIG. 1. The tilting movement is only used to load the rider into the harness, and during the swing, boom 13 will be horizontal.

Figure 4:
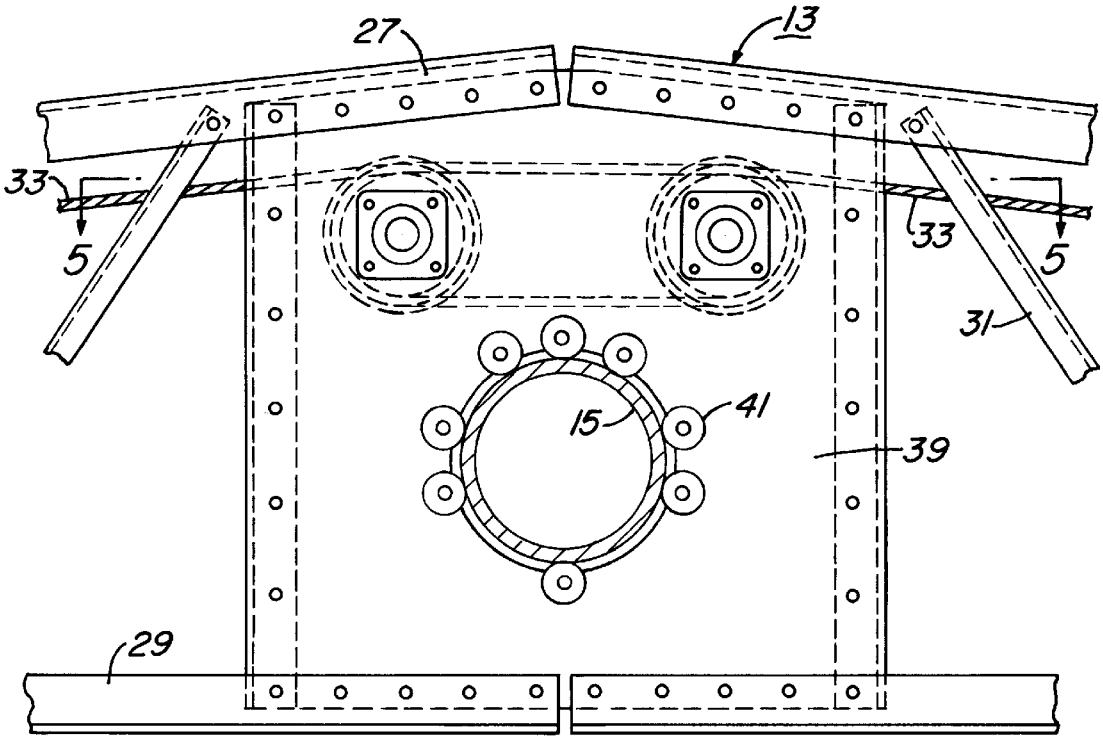
FIG. 4 is an enlarged sectional view of the swing ride of FIG. 1, taken along the line 4—4 of FIG. 3.
Figure 5:
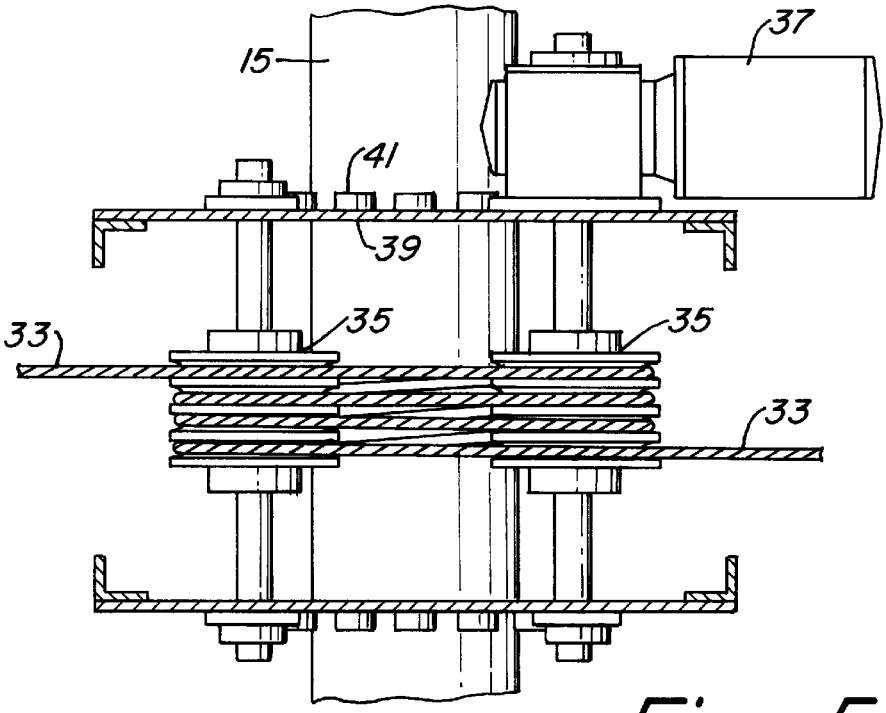
FIG. 5 is a sectional view of the swing ride of FIG. 1, taken along the line of 5—5 of FIG. 4.

Referring to FIG. 4, boom 13 is a truss member, made up of upper chords 27, lower chords 29, and lattice braces 31 in a rectangular configuration. A carriage drive cable 33 extends along the length of boom 13 and passes above stationary cross member 15. Drive cable 33 is a flexible linkage which extends from forward end 17 to rearward end 19, is fixed in length, and is reeved over a pair of sheaves 35. One of the sheaves 35, shown in FIG. 5, is connected to an electrical drive motor 37. Drive motor 37 and sheaves 35 are mounted to side plates 39 of boom 13. A plurality of rollers 41 are mounted to each side plate 39 for rolling contact with cross member 15. Rollers 41 allow the tilting of boom 13 to occur.

Figure 6:
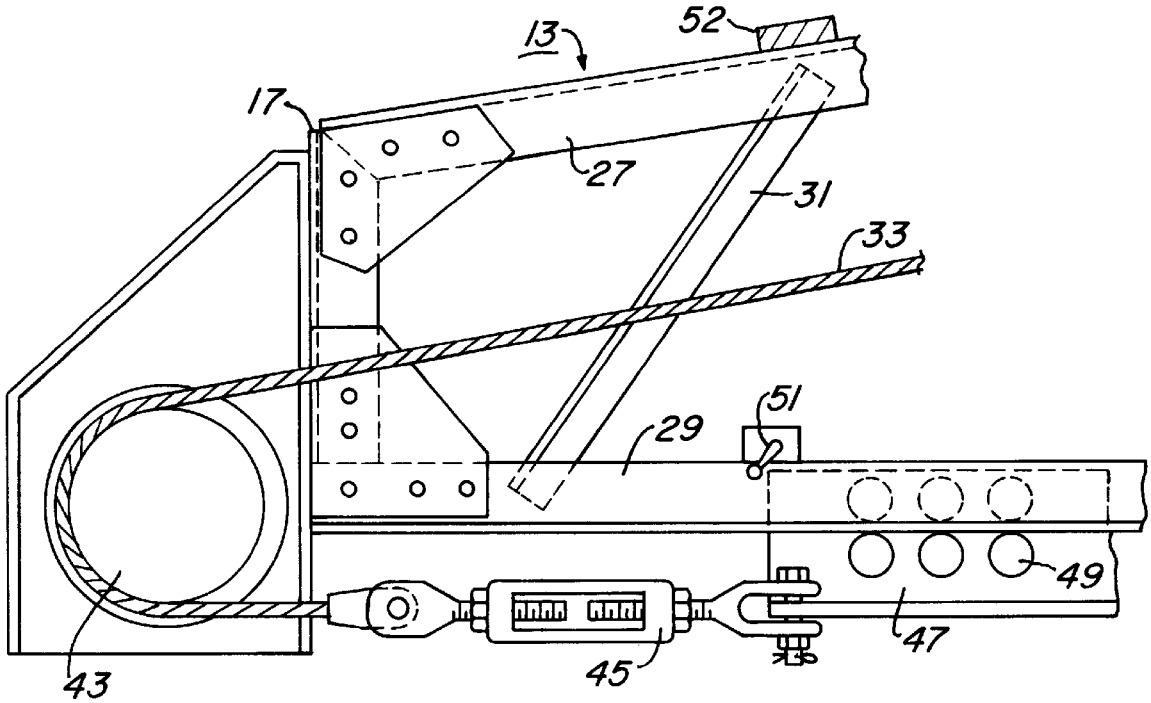
FIG. 6 is an enlarged partial sectional view of a forward portion of the boom of the swing ride of FIG. 1.

Referring to FIG. 6, forward end 17 of boom 13 is shown partially in section. Drive cable 33 passes over a sheave 43 rotatably mounted to forward end 17. Drive cable 33 then extends to a turnbuckle 45, which is connected to a carriage 47. Carriage 47 has rollers 49 that roll on flanges of the T-shaped lower chords 29. When drive motor 37 (FIG. 5) is actuated, drive cables 33 will move carriage 47 between forward end 17 and rearward end 19. A limit switch 51 is contacted by carriage 47 as it reaches its extreme forward position adjacent forward end 17. A similar limit switch will exist adjacent rearward end 19.

Figure 7:
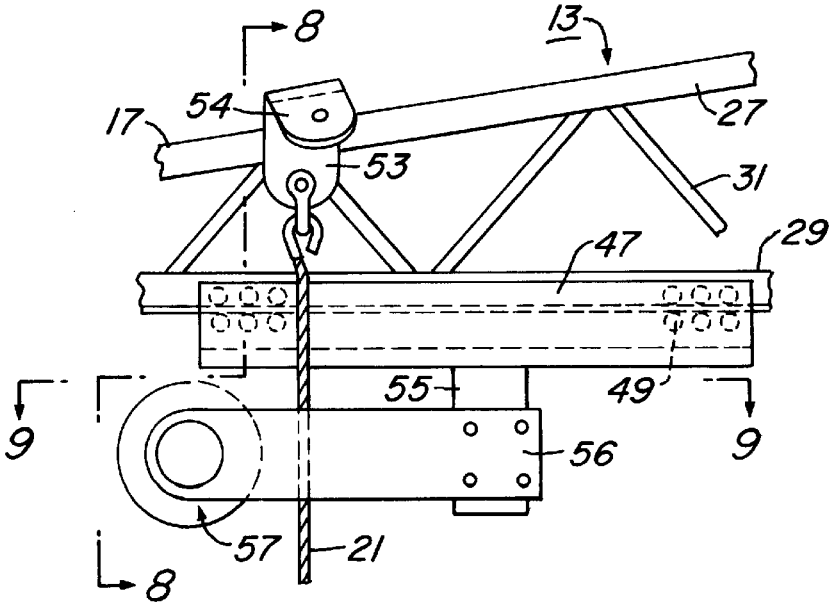
FIG. 7 is a side view of a forward portion of the boom of the swing ride of FIG. 1, but with portions of the structure shown in FIG. 6 not being shown to illustrate other portions of the structure.
Figure 8:
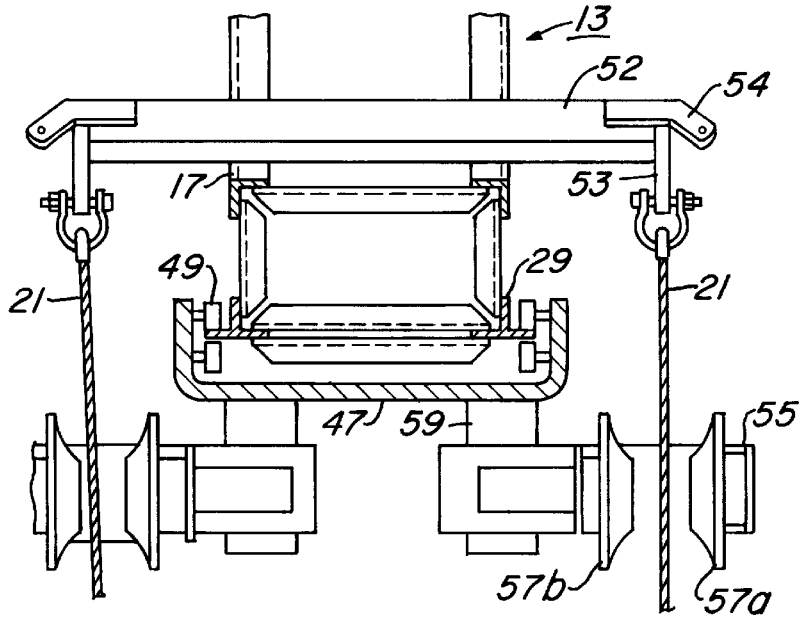
FIG. 8 is a sectional view of a forward portion of the boom of the swing ride of FIG. 1, taken along the line 8—8 of FIG. 7.

As shown also in FIG. 8, a stationary beam 52 extends transversely across boom 13 near forward end 17. A similar beam (not shown) will be located adjacent rearward end 19. A pair of brackets 53 are secured to each end of beam 52, shown also in FIG. 7. Brackets 53 support the upper ends of swing cables 21. A bracket 54 is also mounted to each end of beam 52. Brackets 54 support the upper ends of the fixed support cables 23 (FIG. 1), which are not shown in FIGS. 6–8. There are also a pair of brackets 54 adjacent rearward end 19 for supporting the upper ends of the support cables 25 (FIG. 1).

Carriage 47 includes a pair of pivot arms 55 secured to a horizontal brace 56. Pivot arms 55 and braces 56 are not shown in FIG. 6 because the sectional view of FIG. 6 is taken through a centerline of boom 13. Carriage 47 has an engaging member which includes a split pulley 57 which has one half 57*a* mounted to each brace 56. The other half 57*b* of split pulley 57 is mounted to a brace 59 (FIG. 9) that is rigidly mounted to carriage 47. Pulley halves 57*a*, 57*b* may be closed together, as shown in FIG. 9, serving as bearing members to trap one of the swing cables 21 between braces 56, 59 and pivot arm 55.

Figure 9:
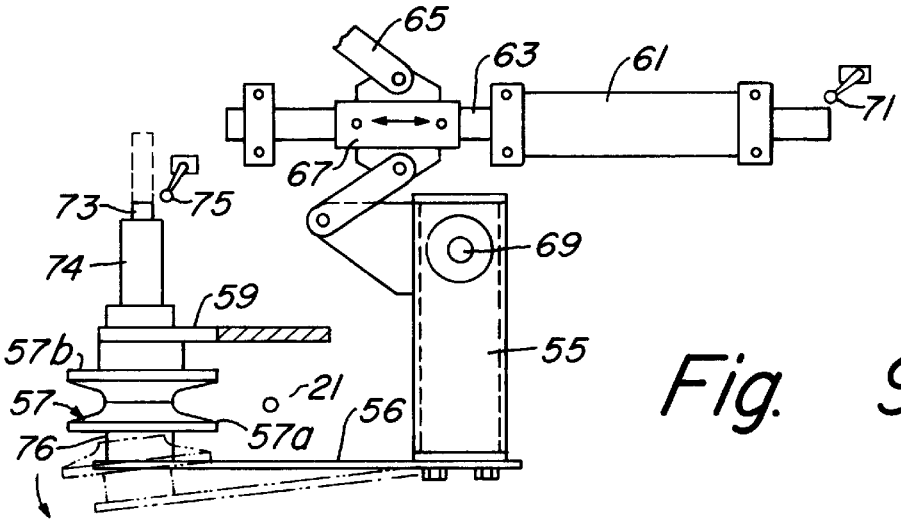
FIG. 9 is a sectional view of a forward portion of the boom of the swing ride of FIG. 1, taken along the line 9—9 of FIG. 7.

Pivot arms 55 will rotate to an open position, shown by the dotted lines of FIG. 9, when actuated by a hydraulic cylinder 61. Hydraulic cylinder 61 is biased to the closed position and has a shaft 63 extending in a forward direction. A collar 67 is fastened to shaft 63 for movement therewith. Linkages 65 extend laterally outward from collar 67 to each pivot arm 55. Each pivot arm 55 is pivotally mounted by a stationary vertical pin 69 to carriage 47. When piston 61 is actuated, it causes pivot arms 55 to rotate about pins 69, separating pulley half 57*a* from pulley half 57*b* as shown in FIG. 8. This allows swings cable 21 to pass forward of split pulleys 57. A limit switch 71 senses when shaft 63 is in the retracted position.

A lock pin 73 extends through a hollow axle 74 that supports one of the pulley halves 57*b*, as shown in FIG. 9. Each pulley half 57*a* is mounted to a stub axle 76 which is also hollow. Pins 73 will extend through axles 74, 76 when pulley halves 57*a*, 57*b* are in the closed position. Because of the arcuate path taken by pulley halves 57*a* when moving to the open position, lock pins 73 must first be retracted from axles 76 before pivot arms 55 can move pulley halves 57*a* to the open position. The close fit of pins 73 in the bores of axles 76 prevents pulley halves 57*a*, 57*b* from separating otherwise. Lock pins 73 are solenoid actuated. A limit switch 75 senses when each lock pin 73 is in the retracted position. A control circuit (not shown) will not allow hydraulic cylinder 61 to actuate until lock pins 73 have moved to the retracted position as indicated by limit switches 75.

Figure 10:
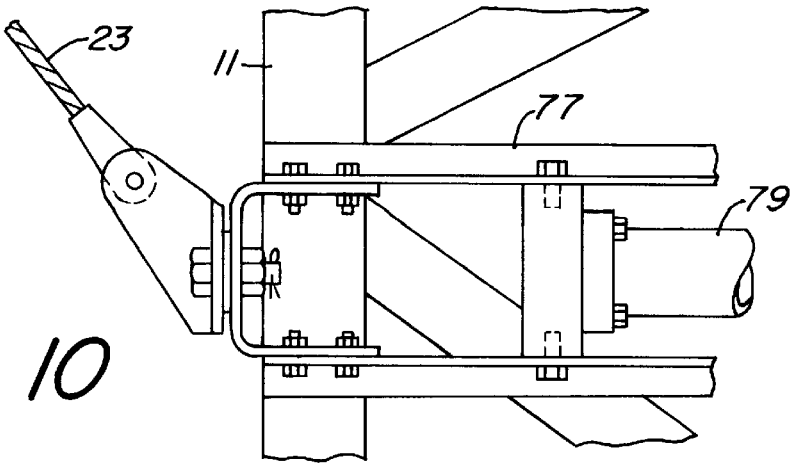
FIG. 10 is an enlarged side view of a lower portion of one of the fixed support cables of the swing ride of FIG. 1.
Figure 11:
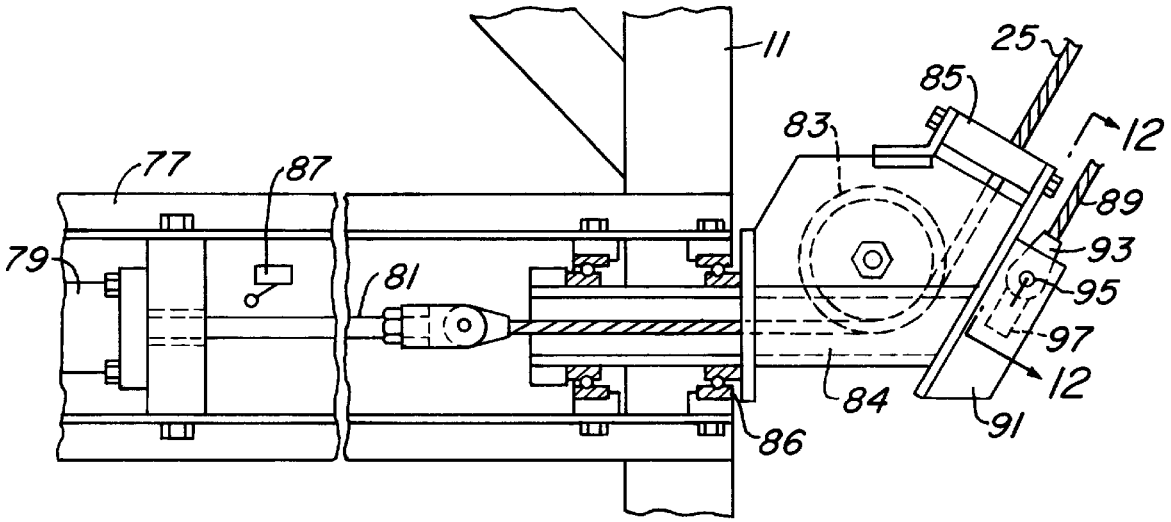
FIG. 11 is a partially sectional view of a lower portion of one of the movable support cables of the swing ride of FIG. 1.

Referring to FIG. 10, the lower end of each fixed support cable 23 is mounted to the forward edge of each leg of tower 11 by a bracket 77. One of the brackets 77 is located on a side of each leg of tower 11 and extends from a forward edge to a rearward edge. A stationary end of a horizontally extending hydraulic cylinder 79 is fixed to bracket 77. Referring to FIG. 11, which shows the rearward edge of bracket 77, hydraulic cylinder 79 has a shaft 81 that is connected to movable support cable 25. Movable support cable 25 extends over a pulley 83 and then to rearward end 19 of boom 13. Pulley 83 is mounted to a cylindrical tube 84 which can rotate about its axis on bearings 86 to accommodate a slight angular change of movable support cable 25 as boom 13 tilts. A guide 85 is mounted to tube 84 for guiding movable support cable 25 between. A limit switch 87 informs the operator when shaft 81 is in retracted and extended positions.

Figure 12:
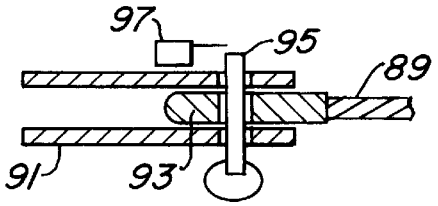
FIG. 12 is a sectional view of a lower portion of a safety cable for the swing ride of FIG. 1, taken along the line 12—12 of FIG. 11.
Figure 13:
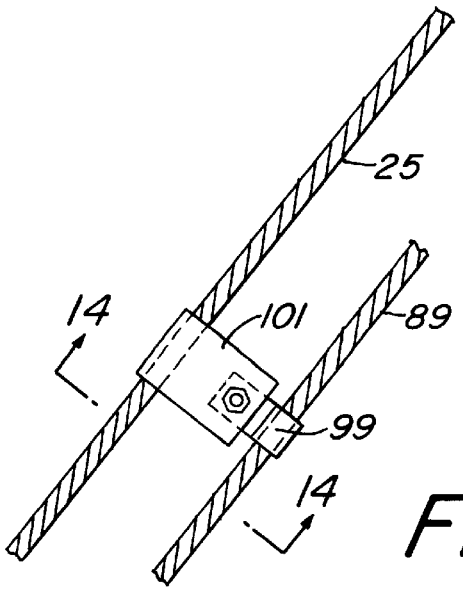
FIG. 13 is an enlarged side view of one of the safety cables of FIG. 12, coupled to a movable support cable of the swing ride of FIG. 1.
Figure 14:
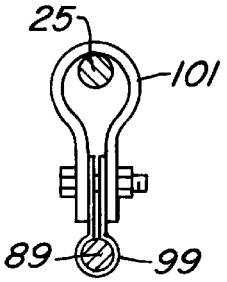
FIG. 14 is a sectional view of the safety cable and support cable of FIG. 13, taken along the line 14—14 of FIG. 13.

A pair of safety lines 89 are utilized to prevent inadvertent tilting when a rider might be in the process of a swing. Each safety line 89 is fixed in length, permanently secured to the rearward end 19 of boom 13 and releasably secured to tube 84. As shown in FIG. 12, each safety line 89 is mounted to braces 91 which are welded to tube 84. An eye 93 is secured to the lower end of safety line 89. A pin 95 extends through holes in braces 91 and eye 93 to secure the lower end of safety line 89. A limit switch 97 provides an indication when pin 95 is in place. A shown in FIG. 13, a strap 99 secures tightly around safety line 89. A loop 101 is secured to strap 99. Loop 101 loosely surrounds movable support cable 25. Safety lines 89 prevent tilting unless first released at their lower ends.

In operation, unless carriage 47 is already at the forward end 17 of boom 13, the operator will first actuate drive motor 37 (FIG. 5) to advance carriage 47 (FIG. 6) all the way to the forward end 17. Limit switch 51 will inform the operator when carriage 47 is in position. Pulley halves 57*a*, 57*b* (FIGS. 7–9) will be open so that swing cables 21 will pass rearward of pulleys 57 as shown in FIG. 9. The operator will close split pulleys 57 by actuating hydraulic cylinder 61 to cause it to move it to the closed position as indicated by the solid lines of FIG. 9. Then, the control circuitry automatically actuates the solenoids of lock pins 73, moving them to the extended position, locking pulley halves 57*a*, 57*b* together.

The operators must first tilt boom 13 to lower the harness for receiving the rider. Two operators position themselves at each leg of tower 11 and remove the safety pins 95 (FIGS. 11, 12). Each operator will grip the lower end of one of the safety lines 89. One of the operators then actuates the hydraulic cylinders 79 to move shaft 81 (FIG. 11) to the extended position, causing the lengths of movable support cable 25 to increase. The additional weight of forward end 17 (FIG. 1) causes it to tilt downward while rearward end 19 tilts upward as shown by the dotted lines. One of the operators then securely fastens the rider into harness 22 at the lower end of swing cables 21. Then, one of the operators actuates hydraulic cylinder 79 to retract, pulling the lower end of movable support cables 25 to the left. This decreases the length of movable support cables 25, causing boom 13 to move back to the level position. Fixed support cables 23 will become taut. Once in place, each operator places one of the safety lines 89 between braces 91 and inserts pin 95, as shown in FIG. 12. Limit switches 97 will then allow the sequence to continue.

The operator then actuates drive motor 37 (FIG. 5) to move carriage 47 from the forward end 17 toward the rearward end 19. As carriage 47 moves toward rearward end 19, the rider will be elevated because swing cables 21 will be trapped by split pulleys 57. When the rider reaches the height at which he wants to be released, the operator will actuate split pulleys 57 to release. First, lock pins 73 retract, then hydraulic cylinder 61 advances, which rotates pivot arms 55 about pins 69 to the dotted line position (FIG. 9). Split pulleys 57 open, freeing swing cables 21 to move forward. The rider will drop, then swing in an arc. The operator and the rider have a choice of releasing swing cable 21 at various distances from rearward end 19 to increase or decrease the height of the swing.

After the rider 21 stops swinging, the operator must tilt boom 13 downward to release the rider because the rider will be several feet above the ground after stopping swinging. The operators will need to pull the safety pins 95 to release the safety lines 89, and repeat the tilting sequence described above. Carriage 47 can be moved to forward end 17 for the next rider while the next rider is getting into the harness and the boom 13 is in the tilted position.

The invention has significant advantages. It provides an exhilarating swing ride for amusement parks without the need for two separate spaced apart towers. It does not require a moveable loading platform to be moved into place and withdrawn each time a passenger is secured to the swing line. This reduces the cost, the area required, as well as enhancing safety.

While the invention has been shown in only one of its forms, it should be apparent to those skilled in the art that it is not so limited but except for various changes without departing from the scope of the invention.

I claim:

1. An amusement ride, comprising:

a tower;

a boom having first and second ends and mounted to the tower;

a swing line having an upper end secured to the first end of the boom;

a carrier secured to a lower end of the swing line for holding at least one passenger;

a carriage carried by the boom for movement along the boom from the first end toward the second end; and an engagement member mounted to the carriage which has a bearing surface which engages the swing line on a side facing the first end of the boom while the engagement member is in a locked position, and which causes the swing line to advance toward the second end of the boom, lifting the carrier, when the carriage is moved toward the second end of the boom, the engagement member having a released position which frees the bearing surface from engagement with the swing line, allowing the swing line and carrier to swing about its upper end.

2. The amusement ride according to claim 1, wherein the boom is pivotally mounted to the tower and wherein the boom has a loading position in which the first end of the boom is tilted downward relative to the second end of the boom for lowering the carrier to receive a passenger, and a riding position which raises the first end of the boom relative to the second end of the boom to raise the carrier safely above the ground.

3. The amusement ride according to claim 1, wherein the boom is pivotally mounted to the tower and wherein amusement ride further comprises:

means for tilting the first end of the boom downward relative to the second end of the boom for lowering the carrier to receive a passenger, and for lifting the first end relative to the second end of the boom to raise the carrier safely above the ground for swinging.

4. The amusement ride according to claim 1 wherein:

the tower has two legs and a cross-member extending between the legs; and boom is mounted to the cross-member perpendicular to the cross-member.

5. The amusement ride according to claim 1 wherein:

the tower has two legs and a cross-member extending between the legs;

the boom is pivotally mounted to the cross-member perpendicular to the cross-member;

the boom has a loading position in which the first end of the boom is tilted downward relative to the second end of the boom for lowering the carrier to receive a passenger, and a riding position which raises the first end of the boom relative to the second end of the boom to raise the carrier safely above the ground.

6. The amusement ride according to claim 1 wherein:

the boom is pivotally mounted to the cross-member perpendicular to the cross-member and wherein the first end of the boom is heavier than the second end of the boom; and wherein the amusement ride further comprises:

a tilt line attached between the second end of the boom and an anchor point lower than the boom, the tilt line when loosened, allowing the weight of the first end of the boom to tilt the first end downward for lowering the carrier to receive a passenger, and when tightened, raising the first end relative to the second end of the boom to raise the carrier safely above the ground before swinging.

7. The amusement ride according to claim 1, wherein the engagement member comprises a split sheave having two halves and a drive mechanism which moves the halves from contact with each other in the locked position to a spaced apart position from each other in the released position.

8. The amusement ride according to claim 1, further comprising a track mounted to a lower side of the boom and extending from the first end to the second end, and wherein the carriage further comprises:

a body which supports the engagement member and is mounted on wheels which roll on the track; and drive means for causing the body to move along the track.

9. The amusement ride according to claim 1, further comprising a track mounted to a lower side of the boom and extending from the first end to the second end, and wherein the carriage further comprises:

a body which supports the engagement member and is mounted on wheels which roll on the track;

a flexible link member secured to the body; and a motor which moves the link member to cause the body to roll along the track.

10. The amusement ride according to claim 1 wherein the swing line is fixed in length.

11. An amusement ride, comprising:

a tower;

a boom mounted to the tower;

a swing line having an upper end secured to the first end of the boom;

a carrier secured to a lower end of the swing line for holding at least one passenger;

a track on a lower side of the boom and extending from the first end toward the second end;

a carriage having rollers which engage the track for movement along the boom from the first end to the second end;

a drive mechanism for causing the carriage to roll along the track from the first end toward the second end of the boom; and an engagement member mounted to the carriage which has a bearing surface which engages the swing line on a side facing the first end of the boom while the engagement member is in a locked position, and which causes the swing line to advance toward the second end of the boom, lifting the carrier, when the carriage is moved toward the second end of the boom, the engagement member having a released position which frees the bearing surface from engagement with the swing line, allowing the swing line and carrier to swing about its upper end.

12. The amusement ride according to claim 11, wherein the boom is pivotally mounted to the tower and wherein the boom has a loading position in which the first end of the boom is tilted downward relative to the second end of the boom for lowering the carrier to receive a passenger, and a riding position which raises the first end of the boom relative to the second end of the boom to raise the carrier safely above the ground.

13. The amusement ride according to claim 11, wherein the boom is pivotally mounted to the tower and wherein the first end of the boom is heavier than the second end of the boom; and wherein the amusement ride further comprises:

a tilt line attached between the second end of the boom and an anchor point lower than the boom, the tilt line when loosened, allowing the weight of the first end of the boom to tilt the first end downward for lowering the carrier to receive a passenger, and when tightened, raising the first end of the boom relative to the second end of the boom to raise the carrier safely above the ground before swinging.

14. The amusement ride according to claim 11, wherein the engagement member comprises a split sheave having two halves and a drive mechanism which moves the halves from contact with each other in the locked position to a spaced apart from each other in the released position.

15. The amusement ride according to claim 11, wherein the drive mechanism comprises:

a flexible link member secured to the body; and a motor which moves the link member to cause the body to roll along the track.

16. The amusement ride according to claim 11, wherein the drive mechanism comprises:

a cable secured to the body and reeved around a pulley; and a motor which rotates the pulley to move the cable and cause the body to roll along the track.

17. An amusement ride, comprising:

a tower;

a boom having first and second ends and pivotally mounted to the tower;

a swing line having an upper end secured to the first end of the boom;

a carrier secured to a lower end of the swing line for holding at least one passenger;

boom having a loading position in which the first end of the boom is tilted downward relative to the second end of the boom for lowering the carrier to receive a passenger, and a riding position which raises the first end of the boom relative to the second end of the boom to raise the carrier safely above the ground; and an engagement member which engages the swing line and causes it to advance toward the second end of the boom, lifting the carrier, and once the carrier is at a desired elevation, releasing the swing line to allow the carrier and passenger to swing downward.

18. The amusement ride according to claim 17 wherein the first end of the boom is heavier than the second end of the boom; and wherein the amusement ride further comprises:

an adjustable anchor mechanism mounted below the boom;

a tilt line attached between the second end of the boom and the anchor mechanism, the anchor mechanism when moved in one direction, loosening the tilt line and allowing the weight of the first end of the boom to tilt the first end downward to the loading position for lowering the carrier to receive a passenger, and the anchor mechanism when moved in an opposite direction, tightening the tilt line to raise the first end of the boom relative to the second end of the boom to raise the carrier safely above the ground before swinging.

19. The amusement ride according to claim 17, wherein the tower has two spaced apart legs and the boom is mounted to a cross-member extending between the legs.

20. The amusement ride according to claim 17, wherein the swing line is fixed in length.

* * * * *